US005272779A

United States Patent [19]

Payton

[11] Patent Number: 5,272,779

[45] Date of Patent: Dec. 28, 1993

[54] BODY SUPPORTS CONTAINING A FIRE RETARDANT EPDM BARRIER

[75] Inventor: John G. Payton, The Colony, Tex.

[73] Assignee: Whim Wham Corporation, The Colony, Tex.

[21] Appl. No.: 757,004

[22] Filed: Sep. 9, 1991

[51] Int. Cl.[5] ..... A47C 27/00

[52] U.S. Cl. ..... 5/459; 5/418

[58] Field of Search ..... 5/459, 483, 468; 297/DIG. 5

[56] References Cited

U.S. PATENT DOCUMENTS

| | | | |
|---|---|---|---|
| 3,272,177 | 9/1966 | Newton | 5/493 X |
| 3,991,134 | 11/1976 | Kraft et al. | 525/169 X |
| 3,992,481 | 11/1976 | Kraft et al. | 525/183 X |
| 3,992,482 | 11/1976 | Kraft et al. | 525/193 |
| 4,193,945 | 3/1980 | Bertelli et al. | 524/106 X |
| 4,254,177 | 3/1981 | Fulmer | 5/459 X |
| 4,308,198 | 12/1981 | Vroomans | 524/413 |
| 4,322,575 | 3/1982 | Skipper | 525/222 X |
| 4,543,281 | 9/1985 | Pedersen et al. | 428/36.91 X |
| 4,547,920 | 10/1985 | Hulsebusch et al. | 5/468 |
| 4,736,911 | 4/1988 | Heitmann | 5/459 X |
| 4,810,565 | 3/1989 | Wasitis et al. | 428/215 |
| 4,866,799 | 9/1989 | Glackin | 5/459 |

FOREIGN PATENT DOCUMENTS

| | | | |
|---|---|---|---|
| 1477145 | 6/1977 | United Kingdom | 5/459 |
| 2067896 | 8/1981 | United Kingdom | 5/459 |

*Primary Examiner*—Michael F. Trettel

*Attorney, Agent, or Firm*—Vogt & O'Donnell

[57] ABSTRACT

A layer of fire retardant EPDM is incorporated into body support devices, such as mattresses, couches, chairs, cushions, pillows and car seats, to provide a partial or total enclosure of flammable materials including polyurethane foam and matting. The fire retardant EPDM layer may be perforated to allow the layer to breathe.

7 Claims, 6 Drawing Sheets

BODY SUPPORTS CONTAINING A FIRE RETARDANT EPDM BARRIER

BACKGROUND OF THE INVENTION

This invention relates to a fire retardant barrier for body support devices such as mattresses, cushions, couches, car seats, chairs, etc., that are commonly used for body support and comfort.

The National Fire Protection Association reported that in the year 1988, there were 33,900 residential fires resulting from careless smoking. Of those 33,900 fires, there were 850 fatalities, 2,211 injuries and $231,000,000 worth of property damage. In addition to residential fires, it is known that, on occasion, persons also have been injured or killed by being trapped in hotel, nursing home and even hospital rooms from fires which stem from fires originating with mattresses and other body support devices. The danger is particularly acute in high-rise hotels, nursing homes and hospitals when a mattress or other body support devices catch on fire.

In general, body support devices have been manufactured by covering an assembly of coiled springs with a combination of polyurethane foam and/or matting which is enclosed in a cover made of ticking or other material. This combination provides lightness, durability and comfort at a reasonable cost.

These body support devices have been found to be extremely dangerous in fires because of the thermal degradation of the polyurethane foam and matting which form combustible liquids and/or gases which can be released suddenly into the surrounding atmosphere and be explosive. That is, due to heat created by the fire, the coils expand and may suddenly rip through the surface of the body support device releasing gaseous and liquefied polyurethane and/or matting and degradation products which can burn with near explosive force when contacted by heat or flame. The end result is that even in a moderate fire, a person in a room containing a burning body support device may be overcome by a sudden increase in heat and smoke created by a sudden rupture of the body support device.

Others have attempted to design body support devices which are fire retardant. Mattresses such as those described by Simon, U.S. Pat. No. 3,512,192, are composed of layers of fiberglass matting which produces irritating glass fibers. Ikeda, U.S. Pat. No. 3,848,283 discloses a mattress that is totally encapsulated within two layers of polychloroprene and a wedge of polychloroprene located at the edge of the mattress which fills in the space between the top and bottom layers of polychloroprene. When this mattress is exposed to heat or fire, the heat causes the inner springs to expand and the sides of the mattress to separate due to the forces of the expanding springs.

The present invention surfaced after an eight year long search for a light, comfortable and affordable way to protect body support devices from flame, fire and cigarettes. Testing was done on carpet backing (too heavy and uncomfortable), light weight rubber from bicycle innertubes (would not pass heat tests), material used in automobile racing suits (too expensive), CSPE (chlorosulphonated polyethylene) almost three times the cost of EPDM (light, comfortable and affordable).

SUMMARY OF THE INVENTION

I have discovered a light, comfortable, durable, fire retardant barrier for body support devices such as mattresses, chairs, couches, car seats, pillows, or other such body support devices. This fire retardant barrier can be installed just under the upper layer of a quilted mattress top, cushion covering, couch covering, car seat covering, chair covering, or used as a total enclosing cover.

The fire retardant barrier of this invention is comprised of a single-ply membrane, i.e., layer, of fire retardant EPDM (Ethylene Propylene Diene Terpolymer) of sufficient strength to maintain form but not so thick as to make the body support device uncomfortable, preferably in the area of 35 mil to 80 mil. This shield may be enclosed by a fitted sheet or covering material and placed on top, i.e., on a body supporting portion, of the body support device, or it may be put between a top covering and a body supporting portion of polyurethane foam and/or matting of the body support device, or it may totally enclose a body support device to block a cigarette and/or other heat and flame source from coming in contact with flammable mattress or cushion materials.

Thus, the present invention is comprised of a body support device and a layer of fire retardant EPDM material which covers at least a body supporting portion of the body support device. Advantageously, it has been discovered that the fire retardant EPDM barrier layer may be perforated to allow the body support device to breathe while still affording protection.

DETAILED DESCRIPTION OF THE INVENTION

The present invention is employed in the construction of body support devices such as mattresses, chairs, couches, covered stools, pillows, cushions, car seats, etc., and particularly in body support devices which contain polyurethane foam. The fire retardant barrier of the invention may be placed or inserted beneath a cover and above the polyurethane foam thus making the body support device capable of withstanding a moderate amount of burning, i.e., of the cover, while shielding the body support devices from the source of the flame or heat. Thus, the fire retardant barrier can be installed just under the upper layer of a quilted mattress top, cushion covering, couch covering, car seat covering, chair covering or used as a total enclosing cover.

In one embodiment the enclosing cover most generally is composed of an upper sheet or other outer covering material, corresponding in shape and size to a plan of the body support device, a similar lower sheet or material, and a side piece seamed together on three sides while the fourth side, preferably along a long side of the body support device, is made closable by a quick release fastener, for example a sliding clasp fastener. This same method can be used to fully enclose the body support device.

Fire retardant EPDM which has the following specifications usefully may be employed:

Specific Gravity 1.5+/−0.05
Tensile Strength 1305 psi min
Elongation 300% min
Tear Resistance 150 lbs./in
Brittleness Temp. −49° F.

TESTING PROCEDURES

EPDM passed the flammability test set out below comprising a modification of PSA Fire Retardant Specification No. 4 (as amended April 1978) of the Steering Committee on Flammability of the Department of the Environment, when using the ignition source (0) as set out in PSA Fire Retardant Specification No. 10 dated September 1976 and amended April 1978.

An EPDM fire retardant mat not only passed the test but did so with little or no damage to any component in the test. The same test was also done on a perforated EPDM mat with perforations of 1/16" spaced at 1" intervals so as to allow the mat to breathe. This sample also passed with little or no damage to any component in the test.

Ignition source (0) of the DOE/PSA Fire Retardant Specification No. 10 (SCOFF Paper No. 4 amended April 1978) is a cigarette, characterizing a smoldering situation.

The cigarette to be used in the test is an untipped cigarette having a length of approximately 68.5 mm, a diameter of approximately 8.0 mm and a weight of 1.0 g nominal, with a smoldering rate of 14.0+/−2 min./50 mm when tested as follows.

The cigarette is marked at distances of 5 mm and 55 mm from the end to be lit and is then lit. Air is drawn through the cigarette until the tip glows brightly and it is then impaled horizontally in draught-free air on a horizontal wire spike inserted to a distance of not more than 13 mm into the unlit end. The time taken for the cigarette to smolder from the 5 mm to the 55 mm mark is noted and should be within the rate set out above.

The flammability test referred to above and comprising a modification of DOE/PSA Fire Retardant Specification No. 4 entitled "Composite Upholstery Ignition Standard (Seating and Bedding)", first issued September 1976 and amended April 1978, is intended to provide a means of assessing inter alia the likely ignition behavior of composite bedding components, comprising the mattress cover with a fire barrier interlining, plus the supporting components which may be flexible foam, other soft infills such as hair, kapok or cotton wadding, etc., spring supports, webbing, torsion springs, platform supports, etc., or any combination of them.

For the present purposes, samples are tested against the ignition source (0) from PSA/FR Specification No. 10 mentioned above.

Articles satisfying the test are adequately flame resistant for use in hospitals. The test is carried out on a sample comprising a resilient support block measuring 45 cm×45 cm and having a thickness equal to the thickness of an equivalent support block intended for normal use. In the case of a mattress, the test block is smaller than the full sized article but in the case of a cushion or pillow or a mattress biscuit constituting part of a full sized mattress, the test block is of the same order of size as the normal article.

The sample to be tested will normally be tested in condition of normal use, fitted with any covers normally applied. The basis of the test method is to ignite the sample under test using a cigarette ignition source (0) and then to measure the distance from the ignition source over which damage occurs.

The sample is placed squarely in its normally horizontal position in still air with no draughts. In the case of a mattress, the sample may be covered with a sheet or sheets to reproduce a full sized bed arrangement which the test sample is intended to represent. The ignition source (0), a cigarette, is placed, after being lit and with the tip glowing brightly, on the upper surface of the sample parallel to and 10 cm from one edge of the sample with each end of the cigarette more than 10 cm from the adjacent edge of the mattress which extends at right angles to the said one edge. The cigarette is allowed to burn its entire length and the sample is observed. A record is made as to whether sustained combustion of any component of the assembly occurs after the cigarette has ceased to burn and the duration of this combustion. The test with ignition source (0) is repeated twice making a total of three tests.

For the sample to pass the test, ignition source (0), a cigarette, two minutes after the ignition source has stopped burning, no combustion of any component or cover shall continue.

DETAILED DESCRIPTION OF THE DRAWINGS

Figure 1:
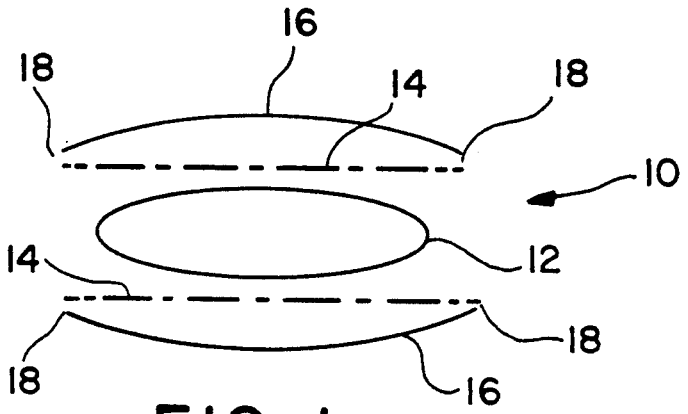
FIGS. 1 and 2 illustrate an embodiment of the present invention for pillows and cushions.
Figure 2:
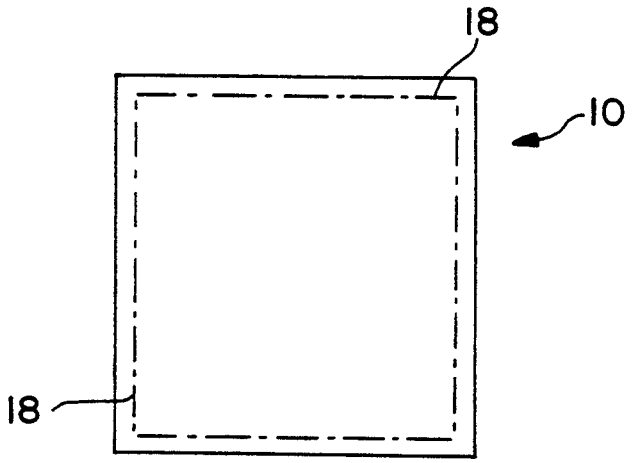

FIGS. 1 and 2 illustrate a cushion or pillow-type body support device which has a central body support portion 12 made of foam or matted padding that is enclosed by a fire retardant EPDM barrier layer 14 and which has a top and bottom cover material 16. The cover 16 is stitched together at its edges 18. FIG. 2 is a top view of body support 10 and edge stitching 18 with an overlap. By having an overlap, such as a two inch overlap, the body support device is protected against any shifting or movement caused by the shifting of body weight and movement of the support device. This concept may be used to enclose any body support device.

Figure 3:
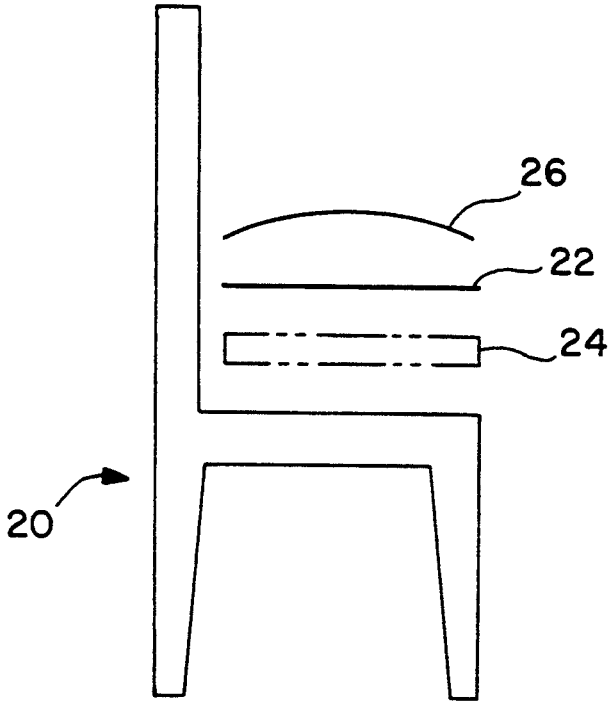
FIG. 3 illustrates an embodiment of the present invention for chairs.

As shown in FIG. 3, body support device 20, shown in an exploded view, has a fire retardant EPDM barrier layer 22 positioned on a polyurethane foam or matting support 24 of the body support device, and a cover 26 positioned above the EPDM layer 22.

Thus, one of the options of this invention is a cover that includes the covering of a top body supporting portion of a body support device as shown in FIG. 3, although the invention also includes covering of the bottom and sides of the body support device.

Figure 4:
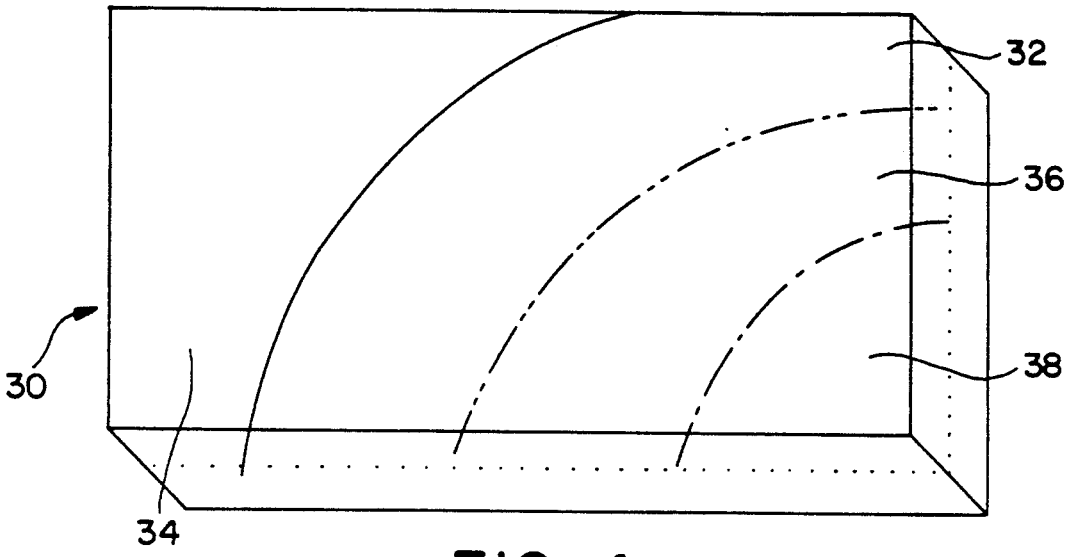
FIGS. 4 and 5 illustrate positioning of a fire resistant EPDM layer in a body support device such as a mattress.
Figure 5:
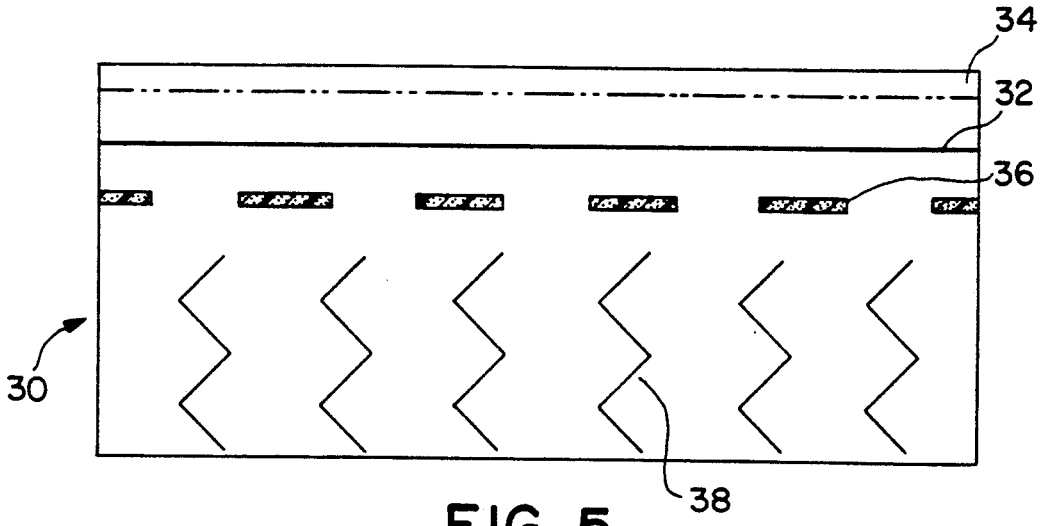

As shown in FIGS. 4 and 5, a body support device such as a mattress 30 has a fire retardant EPDM barrier layer 32 positioned beneath an outer cover 34 such as a quilted skin or cover. The EPDM layer 32 is positioned on such as polyurethane foam and/or matting 36 which, in turn, is positioned upon a spring support system 38.

Figure 6:
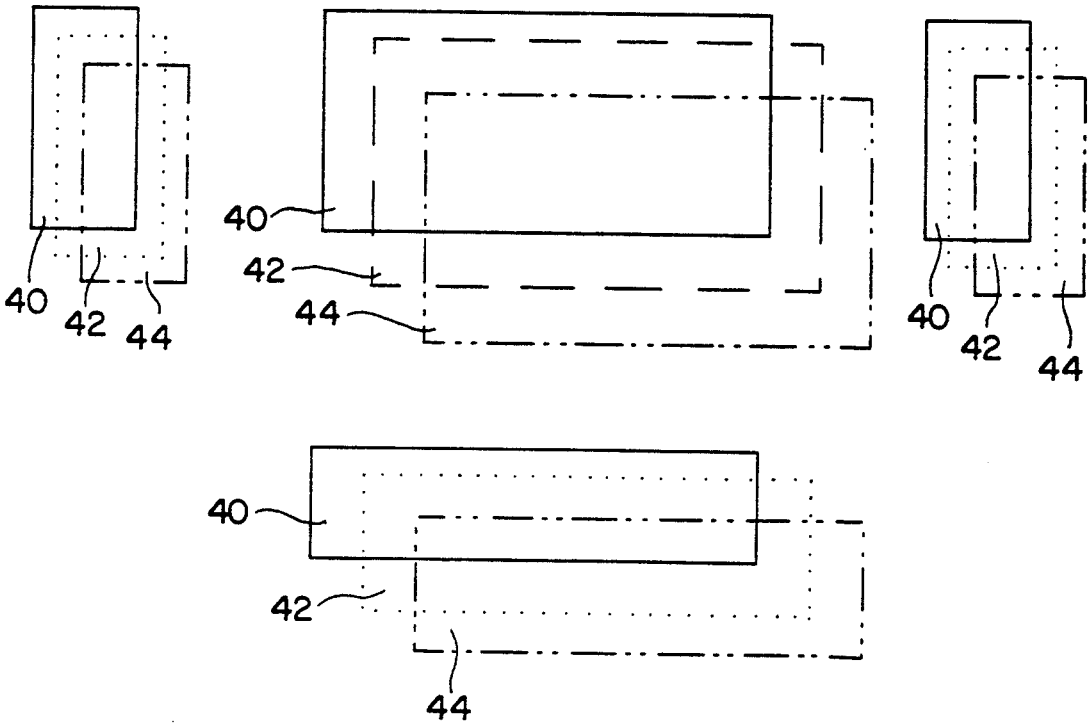
FIG. 6 further illustrates enclosure of a body support device.

A body support device, such as a mattress, may be fully enclosed by stitching the edges of each of sections such as shown in FIG. 6 together. FIG. 6 shows a top sheet 40, a EPDM fire retardant mat 42 and a bottom sheet 44. Top and bottom sheets 40 and 44 may be stitched together on three sides with the fourth side being left open to insert the EPDM mat 42.

Figure 7:
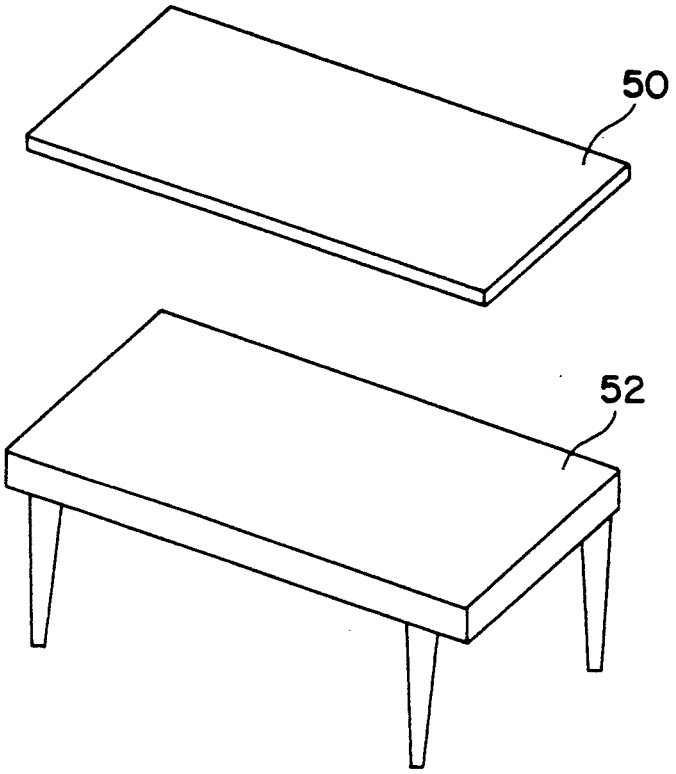
FIG. 7 illustrates use of a fire resistant EPDM mat.

The EPDM may also be used as a flame retardant mat by placing the mat over the outside covering of the mattress, seat cushion, table, as shown in FIG. 7, or any material that one desires to protect. As shown in FIG. 7, the EPDM mat 50 is placed on top of table 52 to protect the table from damage from cigarette burns or other heat source.

Figure 8:
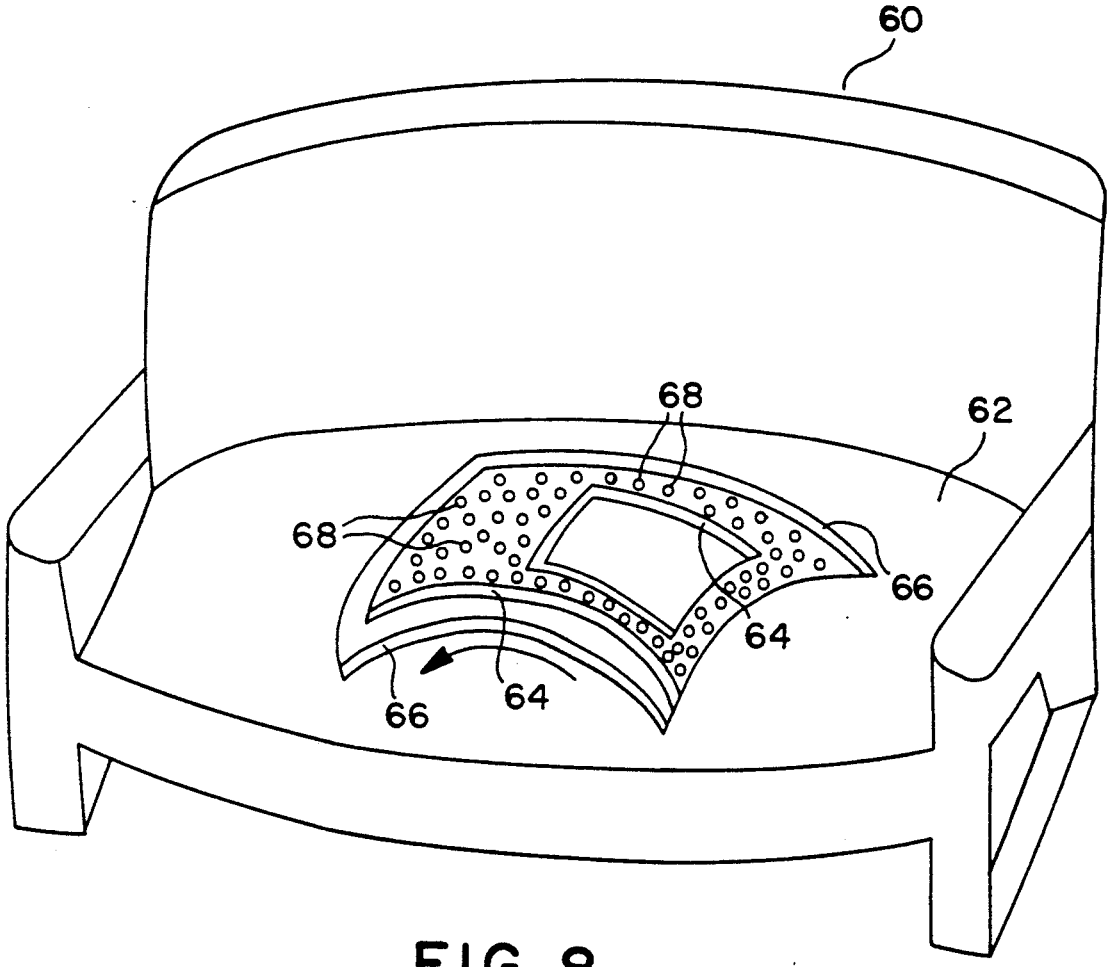
FIG. 8 illustrates a representation of a couch or car seat constructed with a layer of fire retardant EPDM.

FIG. 8 provides an illustration of an embodiment of the present invention which is representative of a couch or a car seat body support device, generally designated by reference numeral 60. As will be noted, a portion of the lateral seating portion element 62 is illustrated as being cut away and folded over to expose the fire retardant EPDM layer 64 which is positioned beneath seat cover or ticking layer 66. FIG. 8 also illustrates fire retardant EPDM layer 64 as having perforations 68.

Although certain preferred embodiments have been described, it should be understood that various modifications within the spirit and scope of the invention are possible.

I claim:

1. An article comprising a body support device and a layer of a single ply membrane of fire retardant EPDM material which has a thickness of up to 80 mil and which covers at least a body supporting portion of the body support device and which has perforations therethrough to allow the body supporting portion covered by the EPDM layer to breathe.

2. An article according to claim 1 wherein the layer has a thickness of from 35 mil to 80 mil.

3. An article according to claim 1 wherein the body supporting portion includes polyurethane foam.

4. An article according to claim 1 wherein the body supporting portion includes a spring assembly.

5. An article according to claim 1 wherein the body support device is a mattress.

6. An article according to claim 1 wherein the body support device is a couch.

7. An article according to claim 1 wherein the body support device is a car seat.

* * * * *